United States Patent [19]

Murdoch et al.

[11] 4,046,083

[45] Sept. 6, 1977

[54] MERCHANDISE DISPLAY SHELVING ASSEMBLY

[75] Inventors: Robert N. Murdoch, Palatine; Vincent M. Travaglio, Rolling Meadows; Michael L. Magnifico, Chicago, all of Ill.

[73] Assignee: Emhart Corporation, Farmington, Conn.

[21] Appl. No.: 673,694

[22] Filed: Apr. 5, 1976

[51] Int. Cl.[2] ..... A47B 9/00

[52] U.S. Cl. ..... 108/107; 108/111; 211/190

[58] Field of Search ..... 108/60, 64, 92, 96, 108/101, 107, 108, 110, 111, 114; 211/189, 190, 193, 206

[56] References Cited

U.S. PATENT DOCUMENTS

| | | | |
|---|---|---|---|
| 2,787,382 | 4/1957 | Williams | 108/108 X |
| 2,991,889 | 7/1961 | Levy et al. | 211/190 |
| 3,209,709 | 10/1965 | Shoffner | 108/108 X |
| 3,263,821 | 8/1966 | Klene et al. | 211/190 |
| 3,297,374 | 1/1967 | Radek | 108/108 X |
| 3,770,135 | 11/1973 | Schild | 211/193 |

*Primary Examiner*—James C. Mitchell
*Attorney, Agent, or Firm*—Hill, Gross, Simpson, Van Santen, Steadman, Chiara & Simpson

[57] ABSTRACT

Spaced hollow vertical posts are supported by base means. Each post has a pair of spaced substantially coextensive vertically elongated flat panel bars of substantial thickness with vertical opposite side edges and a series of vertically spaced shelf bracket connection apertures intermediate the edges, there being a pair of substantially coextensive vertical opposite side channel members of relatively thin gauge material to which the side edges of the panel bars are secured in edgewise abutment. Stabilizing bar means have angular attachment terminal tongues or vertical finishing strips may be engaged with transverse attachments straps on the channels. Gusset members in the base structure support the posts and are formed from horizontally elongated vertically standing panels having plate attachment structure at their ends. The base includes detachable shelf and trim structure. At one end of the assembly, merchandise promotional display extension may be provided comprising a transverse vertical panel and shelf-supporting structure and a horizontal base deck.

45 Claims, 20 Drawing Figures

71
54
58
58
29
29
60
72
59
18
89
90
88
69
28
67
57
65
68
68
64
69
24
63
70
70
63
50
81
20
84
85
87
81
62
61
82
48
40
38
VIII
80
VIII
33
32
VII
48
VII
34
37
42
42
79
80
41
41
31

91
92
93
28
65
24
29
X
23
20
XI
XII
31
98
38
87
78
45
32
85
103
101
42
102
95
94
27
82
81
97
62
40
100
99

XIV
XIV

Fig. 19
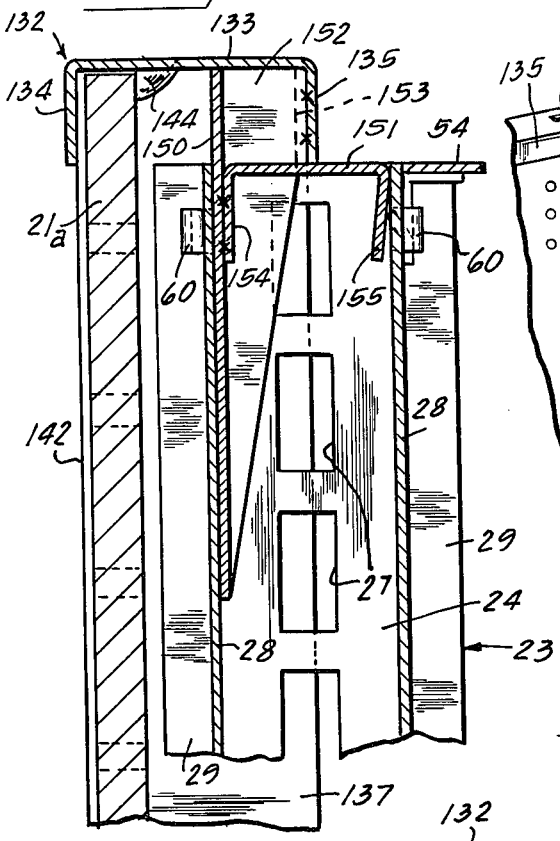
Fig. 16
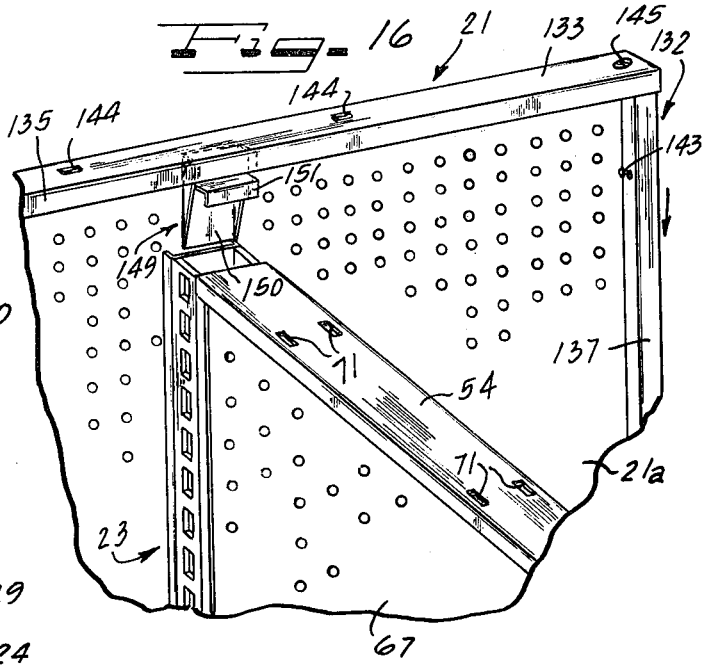
Fig. 17
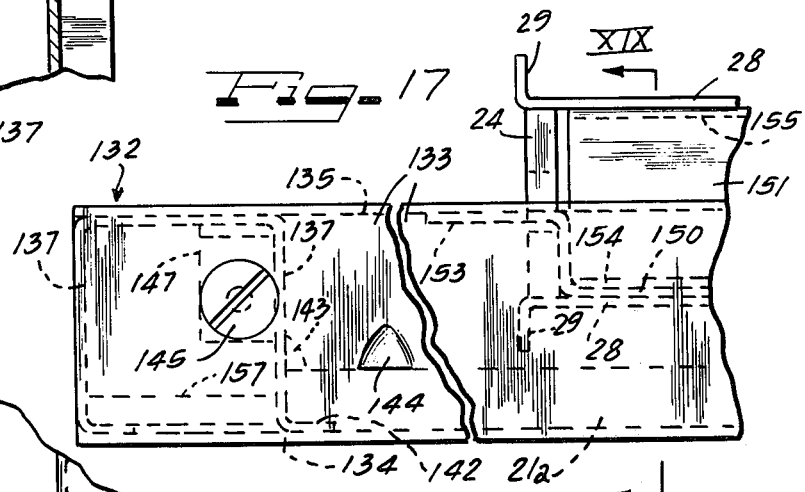
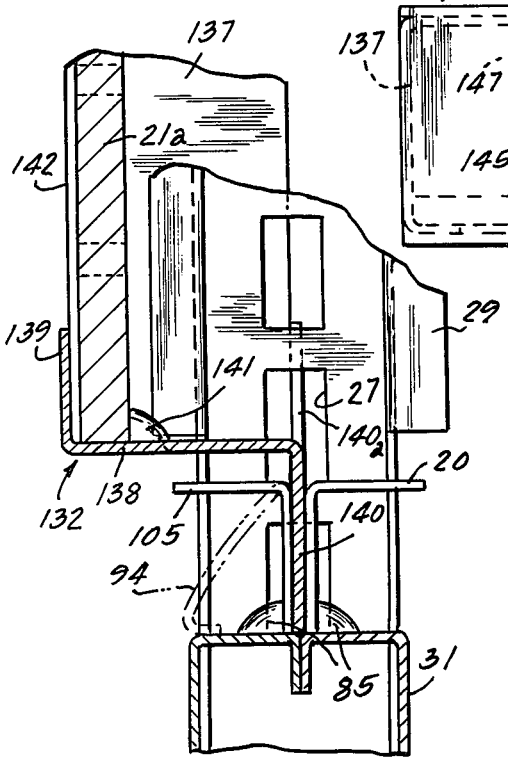
Fig. 20
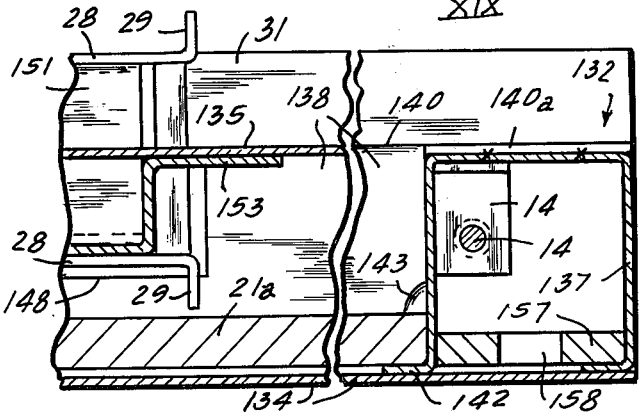
Fig. 18

MERCHANDISE DISPLAY SHELVING ASSEMBLY

This invention relates to new and improved merchandise display shelving assemblies, and is more particularly concerned with knockdown or user erectable shelving structures formed from parts which are shipped unassembled and then assembled at the use site such as in self-service stores.

Shelving assemblies for installation in retail stores of the self-service type are generally known and widely used. For convenience and economy in shipping, installation and utilization, such shelving is manufactured and shipped in unassembled parts for assembly on a unit basis at the use site in unitized sections or gondolas either standing individually or in end-to-end multiples of any desired length. Such shelving is generally provided with individual shelves having brackets which may be releasably secured to upright columns or posts at any desired elevational in order to accommodate various heights and sizes of products to be displayed on the shelves. By way of example of known types of shelving of this character, reference is made to U.S. Pat. Nos. 2,787,382 and 3,770,135.

Original equipment costs are important factors in the type of shelving under consideration, and prior constructions have not met this problem as satisfactorily as desirable, for various reasons, not the least of which is the requirement for excessive numbers of parts thus compounding material and manufacturing costs. Oftentimes parts are required which are of a complexity requiring expensive tooling, and related manufacturing equipment, and involving slow manufacturing procedures.

It is accordingly, an important object of the present invention to provide new and improved merchandise display shelving which will overcome the disadvantages, deficiencies, inefficiencies shortcomings and problems of prior constructions.

Another object of the invention is to provide new and improved merchandise display shelving in which a basic gondola unit may be used individually but can be part of a series of such units, one being built onto the other.

A further object of the invention is to provide new and improved upright shelf-carrying structure including novel column or post structure.

Still another object of the invention is to provide new and improved merchandise display shelving having novel base gusset structure.

A still further object of the invention is to provide new and improved merchandise display shelving including versatile add-on merchandise display structure.

According to features of the invention, a merchandise display shelving assembly comprises base means for supporting upright shelf-carrying structure including spaced hollow vertical posts each having a pair of vertically elongated panel bars with vertical side edges and a series of vertically spaced shelf bracket connection apertures intermediate the edges, vertical channel members along the side edges of the panel bars, and means such as welding securing the side edges in edgewise abutment against the channel members. Stabilizing bar means extend between the posts and have angular attachment terminal tongues receptive in transverse attachment straps on the channels. At the gondola ends vertical finishing strips may be attached to the outer sides of the posts by means of the attachment straps. The stabilizing bar means cooperate with the posts to support backing panels. In the base means sturdy post-supporting gusset assemblies are equipped for convenient, efficient attachment of kickplates and for sturdy support of base shelving.

Add-on features may include transverse end panel and shelf supporting structure and an associated base shelf extension device.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

FIG. 16 is a fragmentary assembly view showing how a transverse end panel is adapted to be assembled with one side of a gondola assembly according to the invention.

FIG. 17 is an enlarged fragmental top plan view taken substantially along the line XVII—XVII of FIG. 1.

FIG. 18 is an enlarged fragmental horizontal sectional detail view taken substantially along the line XVIII—XVIII of FIG. 1.

FIG. 19 is a fragmentary vertical sectional view showing details of the upper end portion of the end panel, and taken substantially along the line XIX—XIX of FIG. 17; and FIG. 20 is a fragmentary vertical sectional detail view taken in substantially the same plane as FIG. 19 but showing details at the lower end portion of the end panel.

Figures 1, 2, 3:
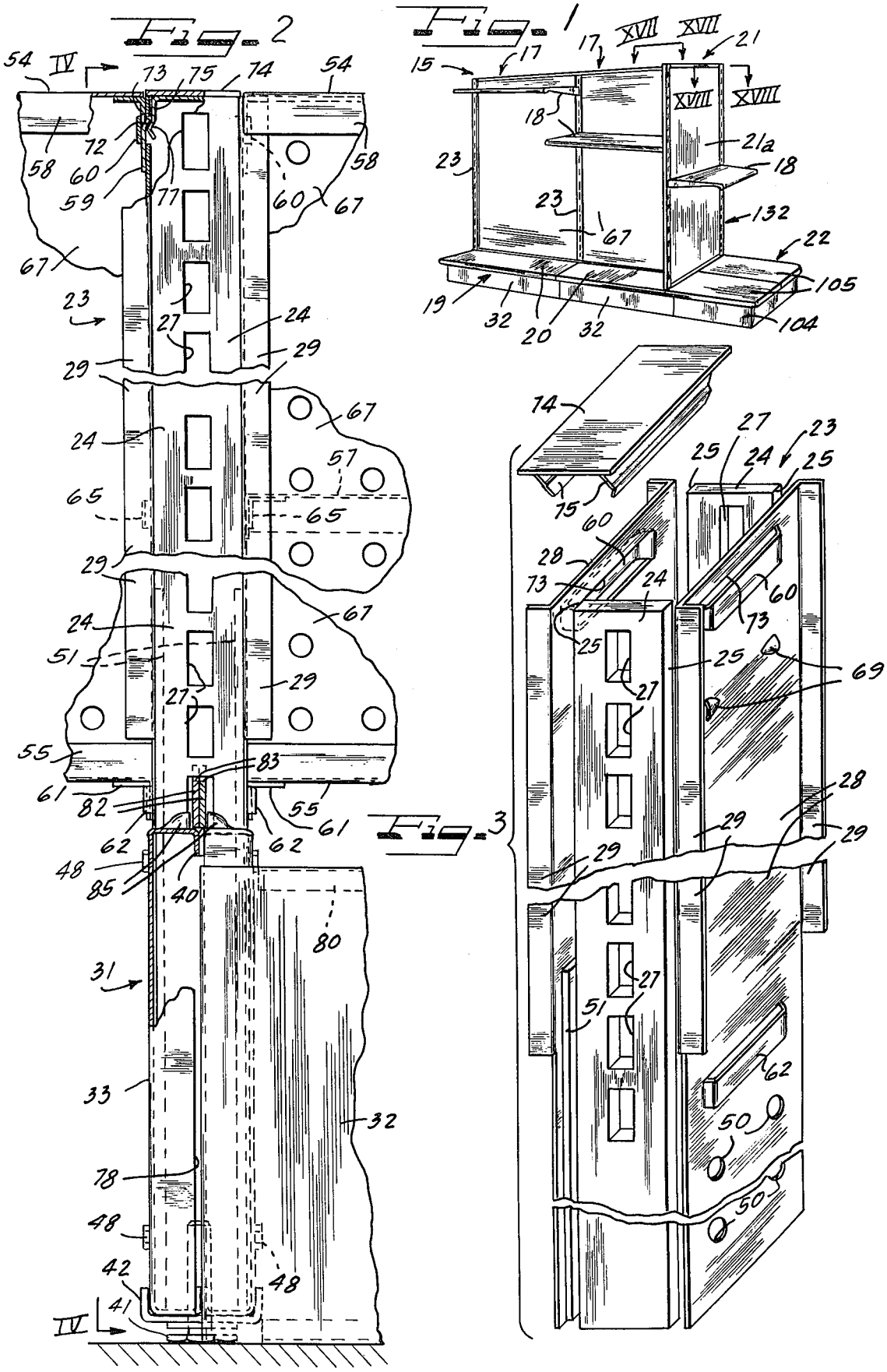
FIG. 1 is a perspective view of merchandise display shelving assembly embodying features of the invention.
FIG. 2 is an enlarged fragmental sectional elevational detail view of generally the central portion of FIG. 1.
FIG. 3 is a fragmental exploded assembly view showing details of the post structure for the assembly.

On reference to FIG. 1, a merchandise display shelving assembly 15 embodying features of the invention comprises at least one merchandise display section or gondola unit 17, preferably double-faced, that is adapted to provide for merchandise display on both opposite faces as by means of one or more, and generally a plurality of shelves 18 supported at any preferred elevation above base means 19 which desirably carries base shelf structure 20. At one or both sides of the basic gondola unit 17 may be connected one or more additional gondola units 17. Add-on or optional features may comprise a transverse end panel 21 connected in upright relation intermediate its sides to the associated gondola unit f17 and suitable equipped to support one or a plurality of the shelves 18 in spaced relation above a display shelving base extension device 22. The end panel 21 and base extension 22 are particularly useful for special merchandise promotional purposes.

Figure 7:
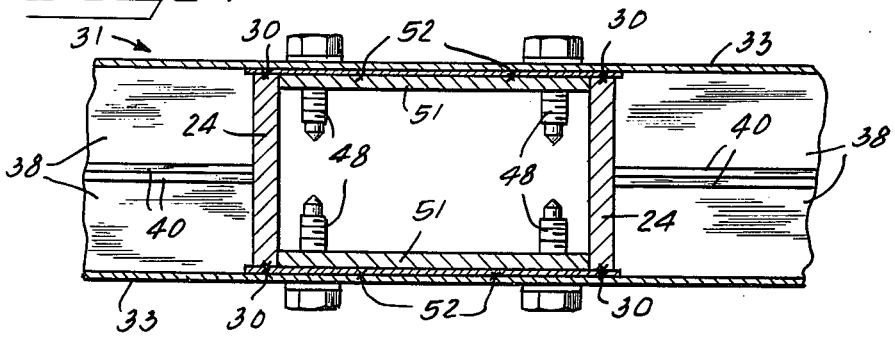
FIG. 7 is an enlarged fragmentary sectional detail view taken substantially along the line VII—VII of FIG. 4.

An important structural feature of the shelving assembly 15 contributing significantly to low cost manufacture, compact and efficient assembly and rugged construction with minimum parts is the hollow vertical post structure 23 located at each side of the basic gondola section 17. Each of the posts 23 comprises a pair of spaced substantially coextensive vertically elongated flat panel bars 24 (FIG. 3) providing opposite shelf-supporting faces for the post. These face bars 24 are of substantial thickness with vertical opposite side edges 25 of substantial width and a series of vertically spaced shelf bracket connection apertures 27 intermediate the edges 25. Engaged with and along the side edges 25, and spaced apart by the width of the panel bars 24, is a pair of substantially coextensive vertical opposite side channel members 28 of relatively thin gauge material and each having along its opposite edges respective reinforcing and retainer flanges 29 which extend sidewardly away from the bars 24. A rigid, unitary post structure is provided by securing the bar edges 25 in edgewise abutment against the backs of the channel members 28 adjacent to the flanges 29 as by means of welding 30 (FIG. 7). Desirably, the face bars 24 may be formed from easily worked steel of about 3/16 inch thickness, and the channel members 28 may be formed from easily worked steel of about 3/64 inch thickness. The construction and relationship of the bars 24 and the channel members 28 permits the parts to be made from strip material in high production punch and die forming equipment, and the parts welded together in continuous strip welding apparatus.

Figure 6:
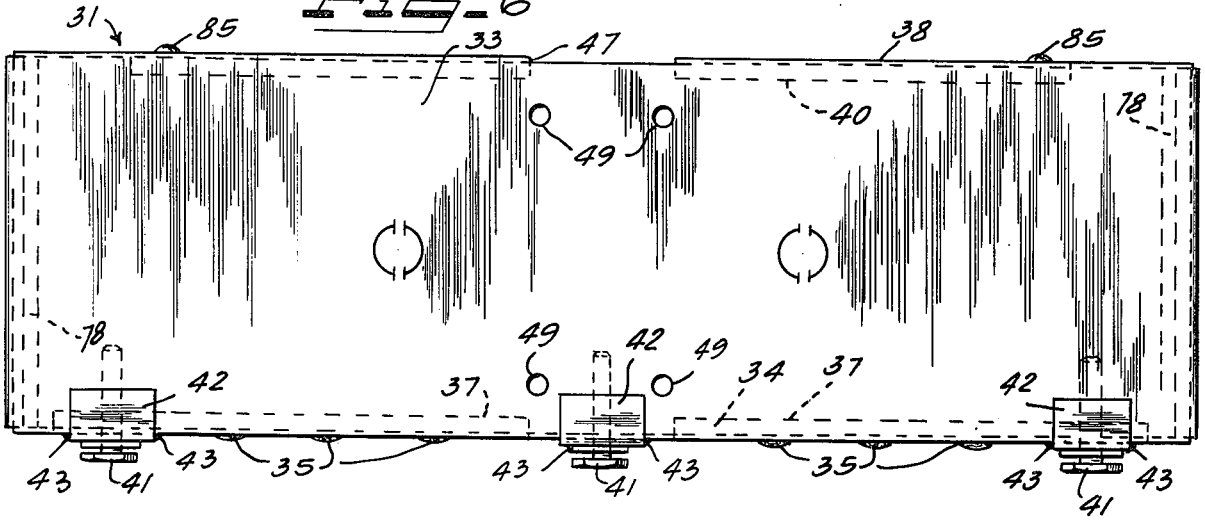
FIG. 6 is a side elevational view of the base gusset member.

For supporting the posts 23 vertically, the base means 19 comprise respective gusset units 31 (FIGS. 2, 4, and 5–8) constructed not only to support the posts but also to provide support for the base shelf structure 20 and to provide means for connection of the kickplates 32 in the base means. In a simple, economical, efficient, rugged construction each of the gussets 31 comprises an assembly of a pair of substantially identical horizontally elongated vertically standing coextensive suitably spaced panels 33 formed from suitable sheet metal and secured in fixed relation to one another to provide a rigid body. Along their lower edges the panels 33 are provided with angularly inturned substantially coextensive reinforcing and spacer flanges 34 which abut one another and are secured permanently as by means of bead welding 35 (FIG. 6). Additional reinforcing rigidity is attained by means of upturned abutting flanges 37 along the abutting edges of the spacer flanges 34. Similarly, along their upper edges, the gusset panels 33 have generally coextensive reinforcing and spacer flanges 38 turned angularly toward one another from the panels and of the same width as the lower flanges 34. Rigidly fixed securement of the upper flanges 38 to one another is effected as by means of bead welding 39 and ground down flush with the tops of the flanges 38. Depending abutting reinforcing flanges 40 are desirably provided along the abutting edges of the flanges 38.

Along their lower edges, each of the gussets 31 is provided with leveling means comprising a plurality of, herein three, leveling screws 41, each of which is threadedly engaged through the web portion of a U-channel shaped bracket member 42 straddling the lower edge of the gusset and secured thereto as by means of tack welding 43. In a desirable arrangement, one of each of the leveling screws 41, is located adjacent to each opposite end of the lower edge of the gusset, and the third leveling screw is located at the center of the lower edge, the screws extending upwardly through respective clearance apertures 44 provided in the lower flanges 34. In order to permit ready access to the leveling screws 41 from the top of the gusset 31, the upper flanges 38 are provided adjacent to the opposite ends of the gusset with respective clearance openings 45, while at the center of the gusset the leveling screw is threadedly accessible through a post-receiving socket clearance hole 47 in the upper flanges 38. Each of the screws 41 has in its upper accessible end a suitable tool-engageable device such as a screwdriver slot 48.

Each of the gussets 31 is assembled in supporting relation to its associated post 23 by reception of the lower end portion of the post in socket means including the socket hole 47, with the lower end of the post resting on the base flanges 34. To facilitate such assembly, the lower ends of the vertical side flanges 29 of the post channel members 28 terminate at a sufficient distance above the lower ends of the body portions of the channel members 28 to overlie the upper edges of the gusset panels 33 in spaced relation. The lower portions of the bodies of the channel members 28 reasonably closely with the inner faces of the panels 33 in line with the socket hole 47 and the lower end portions of the post panel bars 224 fit down closely within the socket ends of the gusset flanges 38. At their lower ends the panel bars 24 are retained in stabilized relation against canting of the post lengthwise of the gusset by the contiguous end edges of the reinforcing flanges 37 which terminate in vertical alignment with the socket defining edges of the flanges 38. Separable attachment of the posts 23 and the associated gusset 31 in assembly is effected by means of self-tapping screws 48 extending through suitable apertures 49 (FIG. 6) in the gusset body plates 33 and aligned screw holes 50 (FIG. 3) in the lower end portions of the bodies of the chanel members 28 and respective reinforcing plates 51 (FIG. 7) secured as by means of welding 52 to the inner faces of the lower end portions of the channel member bodies. Because of the close fit of the lower end portions of the post 23 within the associated gusset unit 31, the post is held firmly against tilting in any direction relative to the gusset unit.

Figure 4:
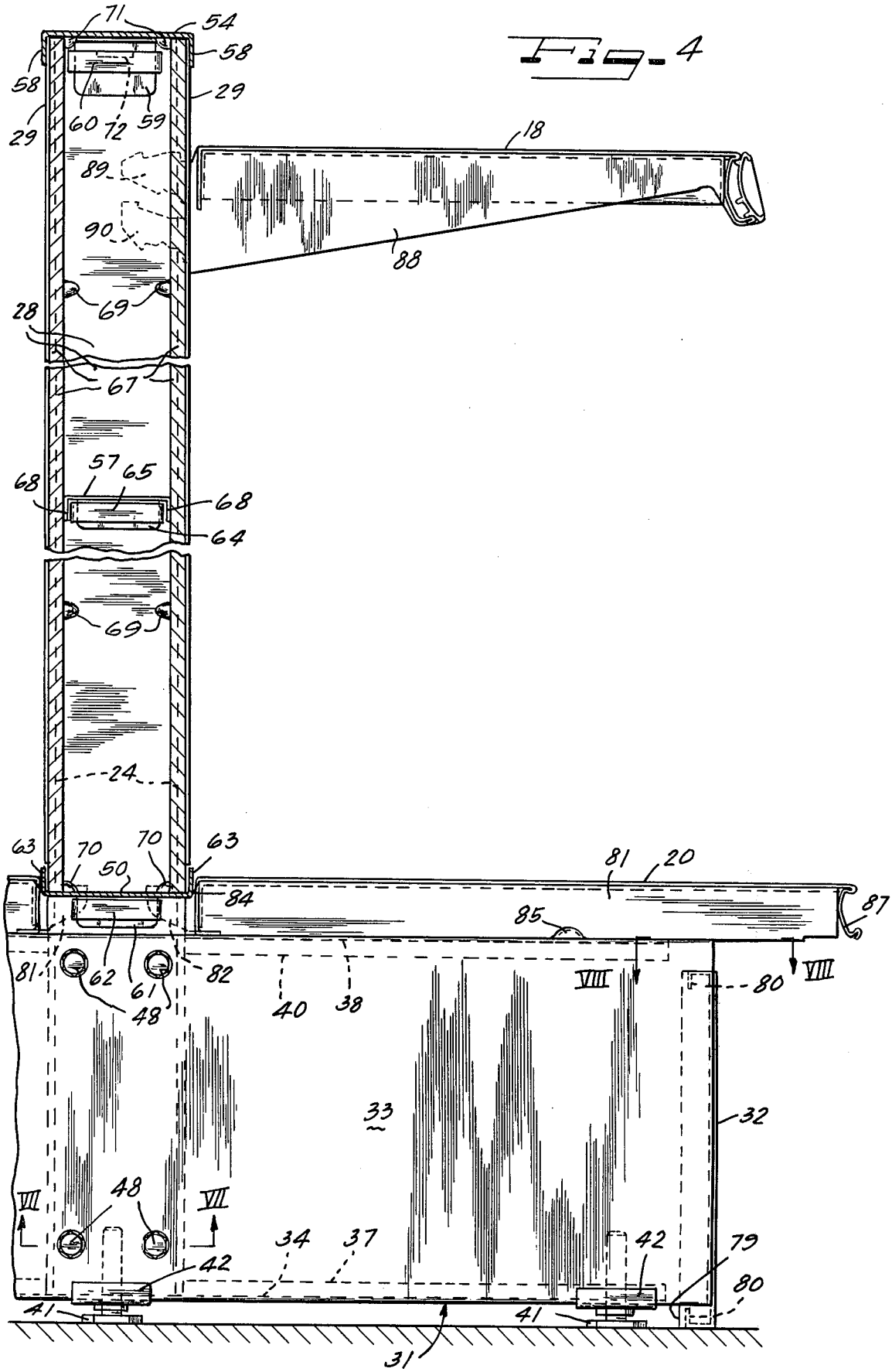
FIG. 4 is a fragmental vertical sectional elevational view taken substantially in the plane of line IV—IV of FIG. 2.
Figure 5:
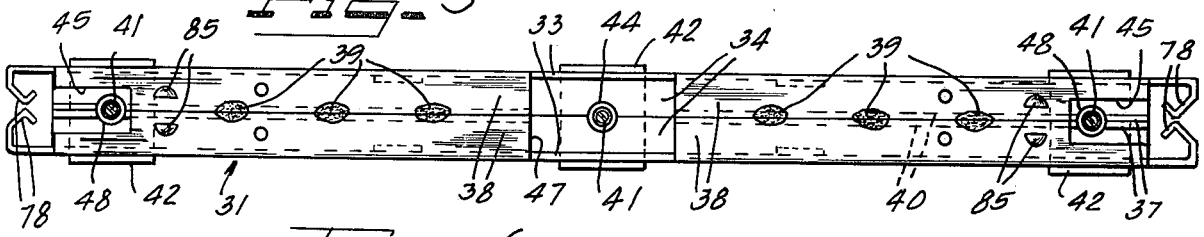
FIG. 5 is a top plan view of a base gusset member.

For attaching the post and gusset assemblies in spaced parallel relation in one of the gondola sections 17, means are provided comprising a plurality of horizontally extending spacing, connecting and stabilizing bars including an upper bar 54, a lower bar 55, and one or more intermediate bars 57 (FIGS. 2 & 4). Each of these bars is of generally channel shape in cross section for rigidity but light weight. In addition to its other functions, the upper bar 54 serves as a top finishing member for the gondola 17, being for this purpose of inverted channel shape and of a width to permit the opposite ends of angular side flanges 58 to lap the outer sides of the upper end portions of the post flanges 29 upon which the end portions of this bar rest. Separable attachment of the top bar 54 to the associated posts 23 is by means of depending tongues 59 projecting downwardly from the opposite ends of the bar 54 and received retainingly in means comprising respective lanced and pressed out complementary integral horizontal attachment straps 60 formed for this purpose on the upper portions of the bodies of the post channel members 28 (FIGS. 2, 3 and 4). By having both of the post body channel members 28 provided with the attachment straps 60, a single post and gusset assembly is adapted to serve as a common side of both of the pair of contiguous gondola sections 17 as depicted in FIGS. 1 and 2, and additional gondola sections may be connected to the remaining outside end posts 23 of the depicted gondola sections to provide an array of connected gondola sections of whatever length desired, with each of the posts 23 being commonto two contiguous gondola sections except at the extreme ends of the array of sections.

Similarly as with the upper bar 54, the lower bar 55 has upon its end portions attachment straps 62 in the lower portions of the bodies of the post channel members 28. In this instance, the bar 55 has its longitudinal angular flanges 63 projecting upwardly and spaced apart sufficiently to receive the lower end portions of the post flanges 29 therebetween when effecting assembly of the bar 55 or removing the same.

Each of the intermediate 57 has as its opposite ends attachment means in the form of depending rigid connecting tongues 64 engageable in means comprising lanced partially struck out complementary horizontal attachment straps 65 on the post channels 28 at a suitable intermediate elevation between the upper and lower attachment straps 60 and 62.

In addition to their other functions, the several bars 54, 55 and 57 serve as supporting and retaining means for shelf back panel boards 67 supported vertically along their lower edge by the lower bar 55, having their vertical edges retained along the posts 23 inside the flanges 29 and their upper edges retained within the top bar flanges 58, and retainingly backed against inward deflection by angular longitudinal reinforcing flanges 68 along the intermediate bars 57 which, for this purpose, are narrower to the required extent than the upper and lower bars. Additional backup retention against deflection of the panel boards 67 is provided by means of lanced pressed out bosses 69, located at suitable vertically spaced intervals on the body portions of the post channel members 28 and also suitably spaced from the adjacent flanges 29 to accommodate the thickness of the panel boards 67. In assembling the panel boars 67, they are slid into position from above in the absence of the upper bar 54, which is then placed into overlying retaining assembly after the panel boards 67 have been assembled. In the assembled relation, the lower edges of the panel boards 67 are desirably held against inward deflection by means of lanced and pressed up bosses 70 at suitable intervals along the lower bar 55 and suitably spaced from the flanges 63 to receive the board edges therebetween. Along their upper edges, the panel boards 67 are held against inward deflection by means of suitable longitudinally spaced lanced and downwardly pressed bosses 71 on the upper bar 54 and properly spaced from the flanges 58.

After the upper bar 54 has been applied to the assembly, a substantially interlocked condition is attained against inadvertent disassembly by engagement of a more or less resilient interlock lug flange 72 (FIG. 2) partially struck from the tongues 59 and projecting obliquely upwardly and engaging with a shoulder 73 along the upper edge of the aperture from which the strap 60 has been struck. When pressing the bar 54 down onto the upper edges of the panel boards 67, with the tongues 59 engaged within the straps 60, the interlock lug flanges 72 will snap into position interlockingly behind the shoulders 73.

After assembly of the top bars 54 has been completed, the upper ends of the hollow posts 23 are closed by means of respective finishing caps 74 comprising simply flat plates with depending resilient retaining shoulder flange fingers 75 on the caps and provided with retaining shoulders 77 releasable engaging with the inturned interlock lug flanges 72 (FIG. 2). When it is desired to dismantle the assembly, the caps 74 can be readily pried free, and the interlock lug flanges 72 released from engagement with the shoulders 73 so tha the top bars 54 can then be removed, and the remaining elements of the assembly readily disassembled.

Figure 8:
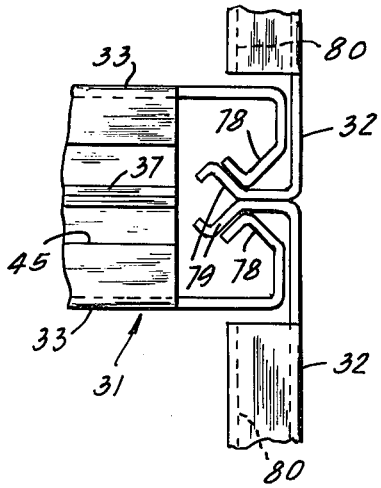
FIG. 8 is an enlarged fragmentary top plan view of one end of the gusset member illustrating cooperation therewith of kickplate members, and taken substantially along the line VII—VIII of FIG. 4.

After the post and gusset assemblies have been oriented and connected together by means of at least the connecting bars 55 and 57, the kickplates 32 are adapted to be assembled in the base structure 19. For this purpose, the opposite ends of the base gusset units 31 are formed with kickplate-attaching means comprising respective angular interlock flanges 78 (FIGS. 2, 5 and 8) on the extremities of the gusset panels 33 and turned toward one another and inwardly in limited spaced gap relation and suitably spaced from the adjacent ends of both the lower flanges 34 and the upper flanges 38. Complementary angular attachment interlock flanges 79 on the ends of the kickplates 32 are adapted to be received interlockingly with the interlock flanges 78 (FIG. 8). Assembly and disassembly of the kickplates 32 relative to the gussets 31 is easily effected by vertically sliding the flanges 79 onto or out of position relative to the gusset flanges 78. Along their upper and lower edges, the kickplates 32 are desirably provided with inturned angular reinforcing flanges 80 (FIGS. 4 and 8).

After the kickplates 32 have been assembled, the base shelf structures 20, in the form of replaceable shelves are adapted to be mounted in place. In a preferred construction, each of the base shelves 20 comprises a flat shelf face plate having fixed along each opposite side a respective supporting bar comprising a depending flange 81 (FIGS. 4, 9 and 20) to rest in supported relation to the top of the associated gusset 31. Each of the flanges 81 is formed on its inner end with a rearwardly projecting tab 82 which is engageable through the lowermost of the apertures 27 (FIG. 2) and with the bar across the top of the aperture engaged in a notch 83 in the top of the tab. Thereby, and with the further assistance of an oblique inwardly and downwardly oblique shoulder 84 leading into the notch 83 and engaging under the bar across the top of the aperture 27, unintentional outward or upward displacement of the shelf 20 is substantially precluded. In order to remove the base shelf 20 it is necessary to pull it slightly forwardly outwardly and then swing it upwardly with a continuing forward or outward pull to release the tabs 82. Sideward displacement of the base shelves 20 relative to the supporting gussets 31 is avoided, and orientation of the gussets 31 with the shelves 20 is maintained by means of upwardly projecting lanced bosses 85 pressed from the upper gusset flanges 34. Along its outer edge, the shelf 20 is desirably provided with a tag rail 87.

Figures 9, 10, 11, 12:
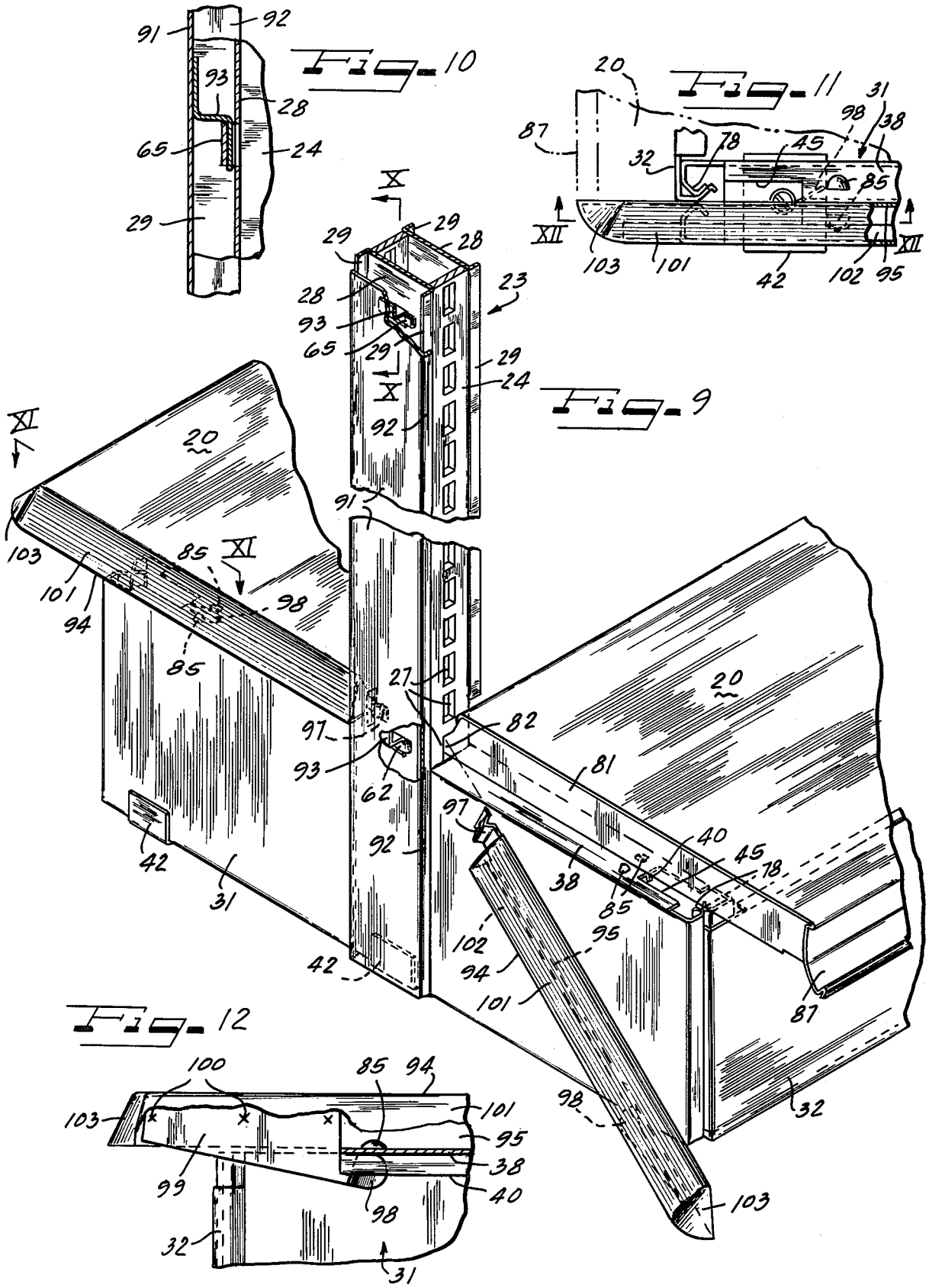
FIG. 9 is a fragmental isometric assembly view of the lower left hand portion of FIG. 1.
FIG. 10 is an enlarged fragmentary sectional detail view taken substantially along the line X—X of FIG. 9.
FIG. 11 is an illustrative top plan view taken substantially along the line XI—XI of FIG. 9.
FIG. 12 is a fragmentary vertical sectional elevational view taken substantially along the line XII—XII of FIG. 11.

The merchandise display shelves 18 may embody features according to the copending application of Travaglio and Magnifico Ser. No. 635,292 filed Jan. 29, 1976, assigned to the same assignee as the present application. Each of the shelves 18 comprises a shelf body having at each opposite side a shelf bracket 88 (FIG. 4) provided at its rear end with upper and lower shelf-supporting tab tongues 89 and 90 engageable through selected ones of the post apertures 27 for supporting the associated shelf 18 at the desired elevation and a selected angle relative to the supporting posts. It wil be appreciated, of course, that although only one of the shelves 18 has been shown in the association with each of the gondolas 17, and with the end panel 21, that as many of the shelves 18 as desired may be provided at each of these locations.

Where one or more sides of the shelving assembly 15 remain open as shown at the left side of FIG. 1, that is, not abutting a wall or partition of the building housing assembly and not equipped with means such as the end display units comprising the panel 21, aesthetically pleasing finishing means are desirably applied along the outer side of the endmost post 23 and along the adjacent sides of the base shelves 20, as best visualized in FIG. 9. For this purpose, a vertical end trim strip 91 is applied to the outer side of the end post 23 and comprises a generally channel shaped member formed up from sheet metal having longitudinal side flanges 92 which lap the adjacent post flanges 29 and are of a length which may extend from adjacent to the lower edge of the associated gusset 31 to the upper end of the post. Readily removable attachment of the finishing strip 91 to the post 23 is effected by means of attachment tongue hanger brackets or clips 93 (FIGS. 9 and 10) carried by the inner face of the strip 91 and suitably located to engage with the attachment strps 60, 62 and 65 of the post.

To provide a finished appearance along the side edges of the base shelves 20, respective end trim strips 93 are provided, which may be formed up from suitable sheet metal in right hand and left hand units and equipped to be mounted by simply sliding them longitudinally into position. Each of the strips 94 comprises a vertically standing horizontally elongated inner side flange 95 of about the same length as the side bar flange 81 of the contiguous base shelf 20 which it confronts in the assembly. At its rear end, the flange 95 has a sinuous locking tab projection 97 which fits into the post slot 27 in which the shelf retaining tab 82 is received and locks the strip 94 against inadvertent axial dislodgement from the assembly. Transverse misplacement of the strip 94 is prevented in part by one of the gusset bosses 85 between which and the side flange 81 the flange 95 fits. In addition, assurance against unintentional lateral or vertical displacement of the strip 94 is provided by a locking tab 98 (FIGS. 11 and 12) which projects downwardly and rearwardly below the lower edge of the flange 95 from a body plate 99 which is secured to the forward end portion of the flange 95 within the strip 94 as by means of spot welding 100. The tab 98 is constructed and arranged to fit down into the top of the slot between the flanges 78 of the gusset member 31 and through the clearance opening 45 in the upper edge of the gusset, with the terminal portion of the tab 98 extending interlockingly under the gusset flange 38 on which the strip 94 rests. At the same time, the tab 98 acts cammingly against the contiguous end portion of the depending reinforcing flange 40 to bias the strip toward the confronting side 81 to the shelf 20. The remainder of the finishing strip 94 is primarily ornamental, comprising an outer panel 101 joined integrally to the upper edge of the flange 95 and extending generally obliquely therefrom to a bottom width about equal to the underlying gusset flange 38 upon which an inturned reinforcing flange 102 along the lower edge of the panel 101 rests in the assembly. At the forward end, the panel 101 is turned into a pleasingly generally convexly contoured terminal 103 which lies concealingly alongside the adjacent end of the contiguous tag rail 87.

Figures 13, 14, 15:
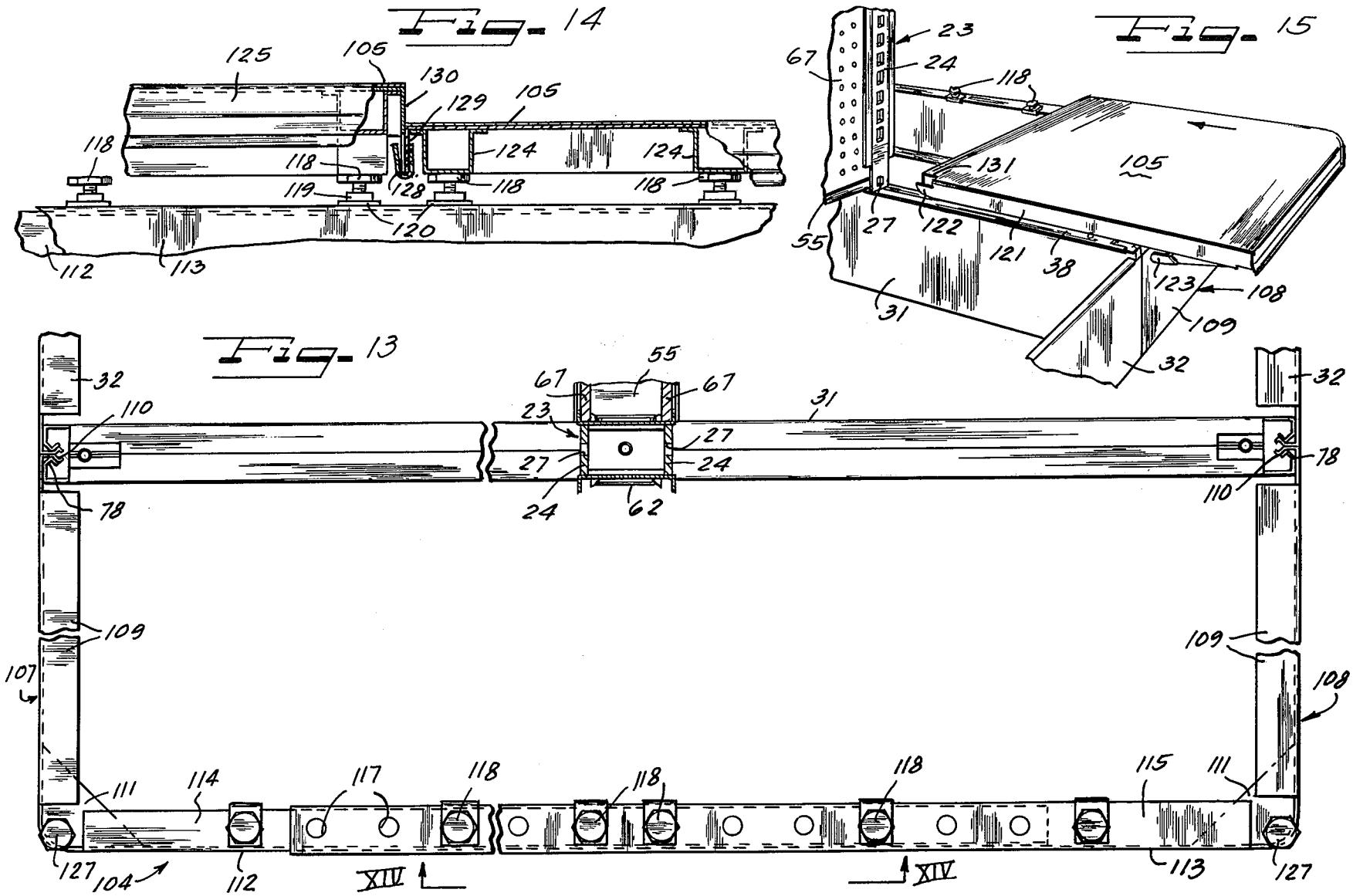
FIG. 13 is a fragmental top plan view of an end base extension kickplate and frame assembly, substantially located at the right side of FIG. 1.
FIG. 14 is a fragmentary vertical sectional elevational detail view taken substantially along the line XIV—XIV of FIG. 13.
FIG. 15 is a fragmentary assembly view showing how one of the end base extension shelf members is moved into position.

Referring now to the end display base extension 22 of the shelving assembly 15 in FIG. 1, principal components comprise a combination kickplate and supporting frame assembly 104 and base shelf means desirably comprising a pair of shelf members 105. Details of these structures are depicted in FIGS. 13, 14 and 15. In a simple and efficient construction, the kickplate and end frame assembly 104 is adapted to be assembled with the adjacent gusset 31 in substantially the same manner as the kickplates 32 are assembled therewith. For this purpose, the frame 104 comprises a pair of generally L-shaped cooperative members which may be referred to as a left hand member 107 and a right hand member 108 as viewed in FIG. 13 and each including respective kickplate section 109 substantially similar to the kickplates 32 and provided at their free ends with interlock flanges 10 interlockingly engageable with the contiguous gusset flange 78 by sliding down from above. At their opposite ends the kickplate sections 109 are connected generally right angularly as by means of welded tie plates 111 to cooperating end panels comprising a kickplate end panel 112 on the section 107 telescopically received in a complementary kickplate end panel 113 on the section 108. By having the kickplate panels 112 and 113 telescopically related, a standardized arrangement is provided which will accommodate shelving assemblies of a substantial range of depths. Top flanges 114 and 115 of the kickplate panels 112 and 113, respectively, overlap and are provided with matching series of spaced screw holes 117 receptive of the shanks of upwardly extending combination leveling and securing screws 118 which are of the type threaded through nuts 119 carried by generally U-shaped spring retaining clamps 120 which straddle the lapped flanges 114 and 115.

After the kickplate frame 104 has been assembled in position, the shelf members 105 are adapted to be mounted in place thereon. This is desirably effected by moving the shelf members 105 toward one another over the frame 104 (FIG. 15) and toward the adjacent post 23, with respective depending flanges 121 along inner sides of the extension base shelves resting on and sliding along the top of the gusset 31 until a remaining tab finger projection 122 on the inner end of the flange 121 engages in a lower post aperture 27. At the same time, a depending interlock tab 123, similar to the interlock tab 98 of the end finishing strip 94, engages under the contiguous gusset top flange 38 and biases the shelf 105 toward the edge of th contiguous shelf 20 in the assembly. Inasmuch as the kickplate frame 104 rests on the supporting floor similarly as the kickplates 32, the leveling screws 118 are relied upon to support the shelf members 105 at a proper elevation level with the top of the gusset 31. In a preferred arrangement the leveling screws 118 are located at suitable intervals to engage under the adjacent ends of reinforcing bars 124 (FIG. 14) which extend in reinforcing relation under the panels of the shelf members 105 from adjacent to the flanges 121 to adjacent tag rails 125 along the opposite outer edges of the shelf members. At the respective outer corners of the kickplate frame 104, corners of the shelf members 105 may be supported by leveling screws 127 suitably carried by the tie plates 111. In the final assembled relation, the shelf members 105 are locked together by means comprising an upwardly opening interlock clip 128 carried by a depending edge flange 129 on one of the base shelf members 105 along the between-shelf joint and in which is received a complementary depending flange 130 along the joint edge of the other of the shelf members 105. Engagement of the flange 130 in the interlock clip 128 may be effected as visualized in FIG. 14 by lifting the base shelf member 105 carrying the flange 130 and dropping such flange into the clip. In order to enble the base shelf members 105 to be in close edge-to-edge contiguity, the corners of the shelf members contiguous to the post 123 are provided with corner clearing notches 131 (FIG. 15) adjacent to the connecting fingers 122.

Before or after the base shelf members 105 have been installed, the transverse end panel 21 unit including a panel board 21*a*, which may be of the same order of material as the panels 67, can be conveniently mounted by moving it in a generally downward direction into the assembly. For this purpose, the panel 21*a* is supported in a preferably rectangular frame 132 (FIGS. 1 and 16–20) constructed and arranged for attachment to the contiguous post 23 and to be supported on the gusset 31 which supports the post. Along the top, the frame 132 comprises a horizontal inverted U-shape channel header bar 133 having a depending flange 134 along its front edge and a depending flange 135 along its back edge. Along each opposite side, the frame 132 has a coextensive hollow vertical bar 137 supported on opposite end portions of a horizontal base bar 138 (FIGS. 18 and 20) of generally Z-shaped cross section including an upstanding flange 139 along its front edge and a depending supporting spacer and retaining flange 140 along its back edge. The lower ends of the side frame bars 137 may be secured to the base frame 138 as by means of welding to the flange 139 and to respective upwardly displaced end sections 140*a* of the flange 140.

Support of the panel 21*a* along its lower edge is on the base frame bar 138 adjacent to the flange 139, with pressed up lanced bosses on the bar 138 suitably spaced from the front flange 139 and adapted to hold the panel 21*a* against displacement away from the flange 139. Along its opposite sides, the panel 21*a* is engaged between respective retaining flanges 142 along the outer faces at the inner sides of the side bars 137 and retaining means bosses 143 pressed from the inner sides of the bars 134 in suitably spaced relation inwardly relative to the flanges 142. Along its top edge, the panel 21*a* is retained by the header bar between the front flange 134 and means comprising retaining bosses 144 suitably lanced and pressed down from the body of the bar 133 in spaced relation inwardly from the flange 134 adequate to receive the thickness of the panel 21*a*.

In order to facilitate assembling the panel 21*a* with the frame 132, and to permit replacement of the panel 21*a* if desired, the top bar 133 is preferably replaceably secured in the frame assembly. To this end, the opposite end portions of the bar 133 are engaged upon the upper squared off coplanar ends of the generally rectangular side bars 137 providing stable seats upon which the engaged body portions of the bar 133 are received and with the flanges 134 and 135 reasonably closely engaging the front and back faces of the bars 137. To secure the top bar 133 against inadvertent displacement and to assure a solid unitary frame structure for the intended srevice, releaseable fastening means in the form of screws 145 (FIGS 16, 17 and 18) attach the end portions of the bar 133 to the tops of the side bars 137 each of which is provided for this purpose with suitable tapped means comprising a bracket member 147 secured as by means of welding to the interior of the upper end portion of each of the side bars.

In mounting the panel unit 21 on the chosen end of the associated shelving assembly 15, the header bar 133 is hung on the top of the associated post 23 such that the back flange 135 of the bar 133 may engage the top of the post, and the depending flange 140 of the base bar 138 may engage with the top of the associated gusset 31. In the preferred arrangement, the lower edge of the flange 140 rests on and supports the frame 132 on the gusset 31, with the flange 140 fitting down between the adjacent edges of the contiguous base shelves 20 and base extension shelves 105 (FIG. 20) as well as between the retaining bosses 85. If no base extension shelf 105 is used than the supporting flange 140 fits between the edges of the shelves 20 and base end trim strips 94 which may be used in the absence of the base shelf extension assembly 22. To permit alignment of the backplane of the frame 132 with the longitudinal center of the top of the gusset 31, the base bar 138 is desirably provided with a suitable clearance notch 148 (FIG. 18) in a central rear portion thereof.

In order to maintain the end panel unit 21 against inadvertent displacement from its mounted position in the shelving assembly 15, fixed coupling means 149 (FIGS. 16 and 19) are desirably provided on the overhanging portion of the header frame bar 133 for interengagement with the upper end portion of the post 23. A simple, rugged construction for the coupling 149 comprises a pair of formed-up suitable gauge sheet metal stampings one of which is in the form of a depending finger member 150 and the other of which is in the form of a spacer member 151. For rigidity and to facilitate mounting, the finger member 150 is of generally U-shape cross section having a head end portion 152 abutting the underside of the bar 133 adjacent to the back flange 135 to which the head portion is affixed as by means of welding lateral attachment flanges 153 (FIGS. 17 and 18) to the inner face of the flange 135. Location and length of the finger 150 are such that in the mounted position of the panel and frame unit the body of the finger 150 will extend to a substantial extent downwardly within the top of the post 23 and engage slidably with the inner face of the contiguous post channel 28 while the sides of the finger 150 engage the respective post bars 24 in freely slidably relation. Such orientation of the finger 150 within the top of the post 23 is positively maintained, for proper spacing of the outer face of the panel 21 from the post, by the spacer member 151 which conveniently comprises a generally inverted U-shape member having a proximal edge flange 154 secured as by means of welding to the body of the finger 150 and with the body of the spacer extending horizontally outwardly close under the lower edge of the flange 135 a sufficient distance to permit engagement of the outer edge of the body of the spacer 151 with the upper end of the post channel 28 which is opposite to the post channel engaged by the finger 150. Assembling of the coupling 149 with the post is facilitated and biasing of the coupling toward the outer side of the post is effected, by equipping the coupling member 151 along its distal edge with a depending cam flange 155 angled obliquely downwardly and toward the finger 150, as best seen in FIG. 19. Through this arrangement, the end panel unit 21 can be easily and quickly installed in the shelving assembly by lifting it into position wherein the outer side of the post 23 is received in the lower frame bar notch 148 and the coupling 149 is centered over the open upper end of the post 23 as shown in FIG. 16. Then the panel unit 21 is moved downwardly, as indicated by directional arrow, to engage the coupling 149 in the top of the post and engage the lower frame bar supporting flange 140 on top of the gusset 31. Removal of the end panel unit 21 is easily effected by reversing this maneuver.

While the end panel unit 21 may serve merely as a backdrop for merchandise carried by the base extension 22, one or more of the shelves 18 supported along the outer face of the end panel unit 21 increase the merchandise display area. For this purpose, the vertical side bars 137 are provided coextensively on their outer faces with respective vertical bar 157 which may be on the same order as the post panel bars 24 having substantial width side edges secured as by means of welding to the contiguous sheet metal walls of the hollow side bars 137. Each of the bar panels 157 has a vertical series of shelf-coupling apertures 158 similar to the apertures 27. Accordingly, one or more of the shelves 18 can be readily mounted on the panel unit 21 by means of the means mounting tabs 89 and 90, similarly as described in connection with the arrangement shown in FIG. 4. By having the panel unit 21 at least as high as the post 23 an advantageous array of the shelves 18 can be supported in association therewith. On the other hand, by having the panel unit 21 of substantially the same width as the width of the shelf extension 22 (measured between the edges of the base shelf members 105 which are aligned with the outer edges of the base shelves 20) and with the lower edge of the unit 21 close to the base shelf member 105, and the base extension 22 extending to a substantial length beyond the face of the unit 21, a commodious merchandise promotional display facility is afforded for the shelving assembly 15.

It will be understood that variations and modifications may be effected without departing from the spirit and scope of the novel concepts of this invention.

We claim as our invention:

1. A merchandise display shelving assembly, comprising:

base means;

upright shelf-carrying structure supported by said base means and including spaced hollow vertical posts each having at least one vertically elongated flat face panel bar providing a shelf-supporting face for the post, said bar being of substantial thickness and having vertical opposite side edges of substantial width and a series of vertically spaced shelf bracket connection apertures intermediate said edges, a pair of substantially coextensive vertical opposite sides of relatively thin gauge material having body portions engaged with said panel bar along said side edges and spaced apart by the width of said panel bar, and means securing said side edges in edgewise abutment against said body portions;

connecting and stabilizing means extending between said posts;

and means on at least one of said side body portions of each post for attaching said connecting and stabilizing means to and between the posts.

2. An assembly according to claim 1, wherein said sides are of generally channel shape cross section having flanges along the longitudinally edges of the body portions extending generally away from said panel bar, and display backing panel means retained by said flanges and said connecting and stabilizing means.

3. An assembly according to claim 2, wherein said connecting and stabilizing means comprise upper and lower horizontally extending bar members of channel cross section having downwardly projecting longitudinal flanges on the upper bar member and upwardly extending longitudinal flanges on the lower bar member cooperating with the post side member flanges and retaining the backing panel means.

4. An assembly according to claim 3, wherein said connecting and stabilizing means include an additional horizontal bar located intermediate said upper and lower bars and providing backing for said panel means.

5. An assembly according to claim 3, wherein said body portions and said horizontal bars have panel means retaining bosses suitably spaced from the respective flanges.

6. An assembly according to claim 1, wherein said connecting and stabilizing means comprise at least one horizontal bar, said bar having depending end attachment tongues, and said means on said side body portions comprising partially severed integral struck out retaining straps with which said tongues are engaged.

7. An assembly according to claim 6, wherein said tongues have interlock means preventing unintentional displacement of said tongues from the straps.

8. An assembly according to claim 7, wherein said straps are located adjacent to the upper ends of the hollow posts, said body portions having openings in alignment with the straps, said interlock means comprising detents projecting from the tongues, and post top closure caps mounted on the top ends of the posts and having retaining means releasably engaged by said detents.

9. An assembly according to claim 1, wherein said base means comprise gussets each of which has a hollow body including side panels with an upwardly opening socket between the panels in which the lower end portions of the posts are received, and a plurality of screws detachably securing comprising post inner faces of said sides to said side panels.

10. An assembly according to claim 9, and reinforcing panels carried by the side body portions within the gussets.

11. An assembly according to claim 9, including base shelf deck means supported on said gussets and having retaining tab structure engaged within apertures in said face panel bar, and finishing strip means mounted longitudinally on top at least one of said gussets alongside said base shelf desk means.

12. An assembly according to claim 11, wherein said finishing strip means including tab structure retainingly engaging with the post in one of said apertures and additional tab structure retainingly engaging with the gusset and biasing the finishing strip toward the base shelf means.

13. An assembly according to claim 1, including a vertical post side finishing strip, and means on the finishing strip and on the side body portion of one of the posts and opposite to said one side portion of such post removably retaining the finishing strip on the post, said retaining means on the opposite side body portion comprising vertically spaced struck out horizontally extending straps, and said retaining means on the finishing strip comprising tongue hanger clips carried by the inner face of said strip.

14. An assembly according to claim 1, including a merchandise display end panel unit, means for supporting said end panel unit along one of said posts in a plane normal to a vertical plane between and through said posts, and means on said end panel unit for supporting merchandise display shelf means.

15. A hollow vertically standing post for use in a merchandise display shelving assembly, comprising:

at least one vertically elongated flat panel bar providing a shelf-supporting face for the post, said bar being of substantial thickness with vertical opposite sides edges of substantial width, and a series of vertically spaced shelf bracket connection apertures intermediate said edges;

a pair of substantially coextensive vertical opposite sides comprising body portions substantially coextensive with said bar and of relatively thin gauge material in engagement with said side edges of said panel bar, and spaced apart by the width of said panel bar;

means securing said side edges in edgewise abutment against said body portions;

and means on said body portions for retaining engagement with connecting and stabilizing means in a display shelving assembly.

16. A post according to claim 15, comprising a pair of said flat panel face bars spaced apart and having their side edges in edgewise abutment against said body portions adjacent to opposite longitudinal edges of said body portions.

17. A post according to claim 16, including longitudinal edge flanges on said body portions projecting away from said bars.

18. A post according to claim 16, including integrally struck out straps extending horizontally and in spaced relation on said body portions for receiving retaining tongues on connecting and stabilizing bar means.

19. A post according to claim 15, including reinforcing means on the inner faces of lower end portions of said body portions to facilitate securing the lower end portions of the post in a base gusset.

20. A merchandise display shelving assembly, comprising:

a post having means for supporting horizontal shelving;

a base gusset unit for supporting said post in upright position;

said gusset unit having a pair of horizontally elongated vertically standing substantially coextensive panels;

flanges along the upper and lower edges of each of the panels turned toward the similar flanges of the other of the panels;

welding securing said upper edge flanges together in edge-to-edge relation and securing said lower flanges together in edge-to-edge relation and the flanges thereby maintaining the gusset panels joined and in spaced relation;

the upper of said flanges having a socket opening intermediate the length of the gusset;

a lower portion of said post extending into said opening in supporting relation between said gusset panels;

and means securing said lower portion of the post in said supported relation.

21. An assembly according to claim 20, wherein said lower edge flanges have upturned reinforcing flanges, said reinforcing flanges cooperating in abutment with said lower portion of said post in maintaining a stable relation of the post with the gusset unit.

22. An assembly according to claim 20, wherein said post has means adjacent to said upper edge flanges of the gusset for interlocking reception of a base shelf retaining means, and said upper edge flanges have means cooperative with said interlock means of the post for retaining base shelf means in position on the gusset unit.

23. An assembly according to claim 20, wherein said gusset panels have coextensive vertical end portions, and inturned flange means on said end portions retainingly receptive of complementary flange means on a kickplate.

24. For use in a merchandise display shelving assembly:

a base gusset unit comprising a pair of horizontally elongated vertically standing panels in spaced substantially coextensive relation;

inwardly extending spacer flanges edge to edge along the upper and lower edges of said panels;

welding securing said upper edge flanges together and welding securing said lower edge flanges together and the flanges thereby maintaining the panels in spaced relation;

and a socket opening in an intermediate portion of the upper of said flanges for receiving the lower end portion of a vertically extending shelf-carrying post.

25. A gusset unit according to claim 24, wherein said lower edge flanges have upstanding lanced upwardly projecting bosses thereon engageable with the lower end portion of the shelf-carrying post for maintaining a stabilized relation of the post relative to the gusset unit.

26. A gusset unit according to claim 24, wherein said upper edge flanges have means thereon for retaining cooperation with base shelf means.

27. A gusset unit according to claim 24, wherein said panels have vertical end edges, and inturned interlock flange means on said end edges adapted for interlocking engagement with complementary interlock flange means on kickplate structure.

28. A gusset unit according to claim 24, including leveling screw means mounted under said lower flanges, and said lower flanges and said upper flanges having openings therein permitting manipulating access to said leveling screw means.

29. A merchandise display shelving assembly, comprising:

an upright self-supporting post;

a gusset unit attached in supporting relation to the lower end of said post and having a portion extending a substantial distance forwardly from the post and providing an upper shelf-supporting edge of substantial width;

a base shelf engaged upon said upper edge and having rearwardly extending attachment tab means; aperture and cross bar means on said post interlockingly engaged with said tab means;

and means on said upper edge cooperating with said tab means and interlock means for retaining the base shelf in position relative to the gusset unit.

30. An assembly according to claim 29, wherein said base shelf occupies about one half the width of said top edge of the gusset member, and a finishing strip occupying the remainder of said upper edge and having tab means engaging within an aperture in the post and with the gusset unit for retaining the finishing strip in place.

31. A merchandise display shelving assembly, comprising:

a base structure supporting an upright post;

said post having means for supporting shelves thereon spaced above said base structure;

an upright panel unit of substantial width having means for supporting shelves thereon;

means on the upper end of the panel unit for connecting said panel unit intermediate its opposite sides to said post;

a base extension comprising a plurality of coplanar base shelves extending from said base structure and the lower part of said panel unit;

said base structure comprising a gusset underlying and supporting said panel unit;

a kickplate frame attached to said gusset and supporting said base shelves;

means separably attaching said kickplate frame to said gusset;

and means connecting said base shelves in edge-to-edge relation providing a deck for said base extension.

32. An assembly according to claim 31, wherein said base shelves are in part supported on the upper edge of said gusset, and leveling means carried by said kickplate frame and adapted to effect leveling of the base shelves with respect to said top edge of the gusset.

33. An assembly according to claim 31, said kickplate frame comprising a pair of telescopically assembled sections.

34. A merchandise display shelving assembly, comprising:

a base structure supporting an upright post;

said post having means for supporting shelves thereon spaced above said base structure;

an upright panel unit of substantial width having means for supporting shelves thereon;

means on the upper end of said panel unit for connecting said panel unit intermediate its opposite sides to said post, said base structure comprising a gusset unit;

said panel unit having means along its lower edge supportingly connecting it to the top of the gusset unit;

and said means on the upper end of the panel unit including a rigid downwardly projecting finger retainingly engaging within an upward opening in the upper end of said post.

35. An assembly according to claim 34, wherein said finger is of generally U-shape cross section and abuts an underside of an overhanging portion of said panel unit, and means on said finger for facilitating assembly of the finger within the upper end of the post and for maintaining lateral orientation of the finger within the upper end of the post.

36. A merchandise display shelving assembly, comprising:

a base structure supporting an upright post;

said post having means for supporting shelves thereon spaced above said base structure;

an upright panel unit of substantial width having means for supporting shelves thereon;

means for supporting said panel unit intermediate its opposite sides along said post;

said panel unit comprising a generally rectangular panel board and a frame comprising a base frame bar retaining the lower edge of the panel board and vertical side bars attached to opposite end portions of the base frame bar and retaining side edges of the panel board and a header bar retaining the upper edge of the panel board and having means detachably securing opposite end portions of the header bar to said side bars;

said frame bars being of substantial width and having means retaining the panel board along the front face of the frame;

and said means for supporting the panel unit being located on portions of the frame bars rearwardly from the panel board and comprising a rigid coupling on an overhanging portion of said header bar engageable with the top end of said post and downwardly extending frame-supporting flange means along the rear portion of the base bar and engaging on top of said base structure.

37. An assembly according to claim 36, wherein said frame bars are formed up from sheet metal, said frame bars having front flanges extending into panel board retaining engagement with front margins of the panel board, and bosses pressed from the bars and engaging retainingly with rear margins of the panel board.

38. An assembly according to claim 36, wherein said coupling comprises a downwardly extending rigid finger engageable in an upward opening in the top end of the post, and said downwardly extending frame supporting flange means comprising a rearward extension from the lower side of the base bar and downwardly extending supporting and spacer and retaining flange on the rear edge of the rearward flange extension and adapted to extend downwardly between dock shelving supported on said base structure.

39. For use in a merchandise display shelving assembly:

a base gusset unit comprising a pair of horizontally elongate vertically standing panels in spaced substantially coextensive relation;

means securing said panels together in said spaced relation;

said panels having a top central opening for reception of the lower end portion of an upwardly extending post;

said panels having at least at one of their coextensive ends kickplate-attaching means comprising respective angular interlock flanges turned toward one another and inwardly in limited spaced gap relation;

said interlock flanges being freely accessible from the upper edge of the gusset unit so that complementary interlocking flanges on the ends of kickplates can be vertically slidably assembled with said angular interlock flanges of the gusset unit.

40. A gusset unit according to claim 39, comprising spacer and connecting flanges along the upper and lower edges of said panels, the edges of said spacer flanges being in abutment, and welding securing the edges of said spacer flanges fixedly to one another, the upper of said spacer flanges being spaced inwardly substantially relative to said interlock flanges of the gusset unit to provide clearance for assembly of kickplate interlock flanges with the interlock flanges of the gusset unit.

41. A gusset unit according to claim 40, wherein said upper spacer flanges have upwardly projecting lanced bosses for maintaining base shelves supported on the gusset from sideward displacement.

42. A gusset unit according to claim 40, wherein said spacer flanges have vertically aligned access openings, U-shaped bracket members straddling the lower edge of the gusset unit and having leveling screws mounted therein and extending upwardly through the openings in the lower spacer flanges and accessible for manipulation through the openings in the upper spacer flanges.

43. A merchandise display shelving assembly comprising:

an upright shelf-supporting post;

a gusset unit attached in supporting relation to the lower end of said post and having portions extending a substantial distance forwardly and rearwardly from the post and providing an upper shelf-supporting edge of substantial width;

a kickplate frame of generally U-shaped having opposite ends connected to opposite ends of the gusset unit;

a pair of deck shelf members supported on said upper edge of the gusset unit and on said kickplate frame;

said shelf deck members having edges in side by side abutment;

means connecting each of said shelf deck members to said post;

and means interlocking each of said deck shelf members to the gusset unit.

44. An assembly according to claim 43, wherein said means connecting said shelf units to said post comprise tabs engaging in apertures in the lower end portion of the post adjacent to the upper edge of the gusset unit, and said interlocking means comprise depending interlock tabs engaging with flange means on the gusset unit.

45. An assembly according to claim 43, wherein the abutting edges of said shelf deck members have interengaging tongue and groove structure for retaining the abutting edges in assembly.

* * * * *